US006228422B1

(12) United States Patent
White et al.

(10) Patent No.: US 6,228,422 B1
(45) **Date of Patent: *May 8, 2001**

(54) SHUTTLE CUTOFF FOR APPLYING GRANULES TO AN ASPHALT COATED SHEET

(75) Inventors: James F. White, Sylvania; Glenn D. Lamb, Granville; Carla A. Miller, Newark, all of OH (US); Lawrence J. Grubka, Vicksburg, MI (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/183,331

(22) Filed: Oct. 29, 1998

Related U.S. Application Data

(62) Division of application No. 08/640,217, filed on Apr. 30, 1996, now Pat. No. 5,858,095.

(51) Int. Cl.[7] ..... B05C 19/04

(52) U.S. Cl. ..... 427/188; 427/201; 118/308; 118/310

(58) Field of Search ..... 118/100, 200, 118/211, 216, 267, 308, 310; 427/138, 186, 188, 201, 212; 251/326, 327; 222/504; 266/44

(56) References Cited

U.S. PATENT DOCUMENTS

| | | | | |
|---|---|---|---|---|
| 1,103,947 | * | 7/1914 | Destrez | 118/308 |
| 1,967,419 | | 7/1934 | Moone . | |
| 2,081,620 | | 5/1937 | Fether . | |
| 3,101,281 | * | 8/1963 | Bowen | 118/310 X |
| 4,250,987 | | 2/1981 | Trammell et al. . | |
| 4,252,299 | * | 2/1981 | LoBue | 266/44 |
| 4,359,176 | * | 11/1982 | Johnson | 222/504 |
| 4,478,869 | * | 10/1984 | Brady et al. | 118/308 X |
| 4,675,209 | * | 6/1987 | Pedigrew | 118/308 X |
| 5,109,893 | | 5/1992 | Derby . | |
| 5,362,028 | * | 11/1994 | Jacobs | 251/327 |
| 5,405,647 | * | 4/1995 | Grubka et al. | 427/188 |
| 5,858,095 | * | 1/1999 | White et al. | 118/308 |

* cited by examiner

*Primary Examiner*—Laura Edwards
(74) *Attorney, Agent, or Firm*—Inger H. Eckert; James J. Dottavio

(57) ABSTRACT

An apparatus for dispensing granules onto a moving asphalt coated sheet includes first and second granule feed chambers containing granules that are fed to a discharge slot by first and second pockets. The pockets are formed in a slidable divider positioned between the feed chambers and the discharge slot. The divider is slid between a first position and a second position by a fluid powered actuator via an actuator rod. In the first position, the first pocket is in communication with the first granule feed chamber to receive granules from the feed chamber and the second pocket is in communication with the discharge slot for discharging the granules contained in the second pocket. In the second position the first pocket is in communication with the discharge slot for discharging the granules contained in the first pocket and the second pocket is in communication with the second feed chamber to receive granules from the feed chamber.

20 Claims, 5 Drawing Sheets

SHUTTLE CUTOFF FOR APPLYING GRANULES TO AN ASPHALT COATED SHEET

CROSS REFERENCE TO RELATED APPLICATIONS

This application is a division of U.S. patent application Ser. No. 08/640,217, SHUTTLE CUTOFF FOR APPLYING GRANULES TO AN ASPHALT COATED SHEET, filed Apr. 30, 1996, now U.S. Pat. No. 5,858,095.

TECHNICAL FIELD

This invention pertains to the handling of continuous strips of asphalt material, such as asphalt material suitable for use as roofing membranes and roofing shingles. In one of its more specific aspects, this invention relates to controlling the application of granules to asphalt strip material.

BACKGROUND ART

A common method for the manufacture of asphalt shingles is the production of a continuous strip of asphalt shingle material followed by a shingle cutting operation which cuts the material into individual shingles. In the production of asphalt strip material, either an organic felt or a glass fiber mat is passed through a coater containing liquid asphalt to form a tacky asphalt coated strip. Subsequently, the hot asphalt strip is passed beneath one or more granule applicators which apply the protective surface granules to portions of the asphalt strip material. Typically, the granules are dispensed from a hopper at a rate which can be controlled by making manual adjustments on the hopper. In the manufacture of colored shingles, two types of granules are employed. Headlap granules are granules of relatively low cost for portions of the shingle which are to be covered up. Colored granules or prime granules are of relatively higher cost and are applied to the portion of the shingle which will be exposed on the roof.

Not all of the granules applied to the hot, tacky, asphalt coated strip adhere to the strip, and, typically, the strip material is turned around a slate drum to invert the strip and cause the non-adhered granules to drop off. These non-adhered granules, which are known as backfill granules, are usually collected in a backfall hopper. The backfill granules are eventually recycled and discharged onto the sheet.

To provide a color pattern of pleasing appearance the colored shingles are provided in different colors, usually in the form of a background color and a series of granule deposits of different colors or different shades of the background color. These highlighted series of deposits, referred to as blend drops, are typically made by discharging granules from a series of granule containers. To produce the desired effect, the length and spacing of the blend drops must be accurate. The length and spacing of each blend drop on the sheet is dependent on the relative speed of the sheet and the length of time during which the blend drop granules are discharged. A uniform distribution of blend drop granules on the sheet is also desired. A uniform distribution produces a sharp distinction between the blend drop and the background areas which provides a more pleasing appearance to the shingle. To produce a uniform distribution, a constant flow rate of granules during the discharge is required.

One method of applying granules to the moving sheet involves discharging the granules from feed rolls which are hoppers having a fluted roll. The fluted roll is rotated to discharge the blend drop granules onto the asphalt sheet. The roll is ordinarily driven by a drive motor, the roll being positioned in the drive or non drive position by means of a brake-clutch mechanism. This mechanical action required to discharge the blend drop granules is burdened with inherent limitations. The duration of granule discharge is too long to produce a short blend drop deposit on a sheet traveling at high machine speeds. Also, the discharge of blend drop granules can not achieve a constant flow rate quickly enough to produce a uniform granule deposit. Consequently, there is a limit to the sharpness of the blend drops on the shingle.

Another method of applying granules to the moving sheet involves discharging granules from an aperture in a nozzle. The granules are fed to the nozzle from a hopper. The discharge of granules from the nozzle is controlled by regulating the flow of granules trough the aperture Generally, the aperture is opened to allow the granules to be discharged from the nozzle and closed to stop the discharge. The flow from the aperture may be aided by gravity, pneumatic pressure or both.

The flow rate of the blend drop granules from the aperture varies while the aperture is opening. The discharge area of the aperture is relatively small when it begins to open. The smaller discharge area provides a reduced flow rate of granules. As the aperture opens the discharge area increases which increases the flow rate until it reaches a maximum flow rate when the aperture is filly open. After this time, the flow rate remains constant until the aperture begins to close. While the aperture is closing, the discharge area decreases which reduces the flow rate until it reaches zero when the aperture is closed. The longer the flow rate variation occurs while the aperture is opening and closing, the less uniform the deposit of granules becomes. In addition, as the speed of the sheet increases the effects of the flow rate variation on the uniformity become more noticeable.

It is desired to provide an improved method for discharging blend drop granules onto the moving sheet to produce a deposit having a uniform distribution of granules.

DISCLOSURE OF THE INVENTION

There has now been developed an apparatus for dispensing granules to a moving asphalt coated sheet where the deposit is generally uniform, having generally sharp, distinct edges. In general the granules are discharged through a discharge slot in the bottom of a granule dispensing apparatus. First and second granule feed chambers contain granules that are fed to the discharge slot by first and second pockets. The pockets are formed in a slidable divider positioned between the feed chambers and the discharge slot. The divider is slid between a first position and a second position by a fluid powered actuator via an actuator rod. In the first position, the first pocket is in communication with the first granule feed chamber to receive granules from the feed chamber, and the second pocket is in communication with the slot for discharging the granules contained in the second pocket. When the divider is in the second position the first pocket is in communication with the slot for discharging the granules contained in the first pocket, and the second pocket is in communication with the second feed chamber to receive granules from the feed chamber.

According to this invention, there is also provided an apparatus for dispensing granules onto a moving asphalt sheet comprising a granule feed chamber and a slot in the feed chamber for discharging granules onto the sheet. A slidegate is mounted on the feed chamber to open and close the slot. An actuators moves the slidegate between an open and closed position to control the discharge of granules onto the sheet.

Various objects and advantages of this invention will become apparent to those skilled in the art from the following detailed description of the preferred embodiment, when read in light of the accompanying drawings.

BEST MODE FOR CARRYING OUT THE INVENTION

Figure 1:
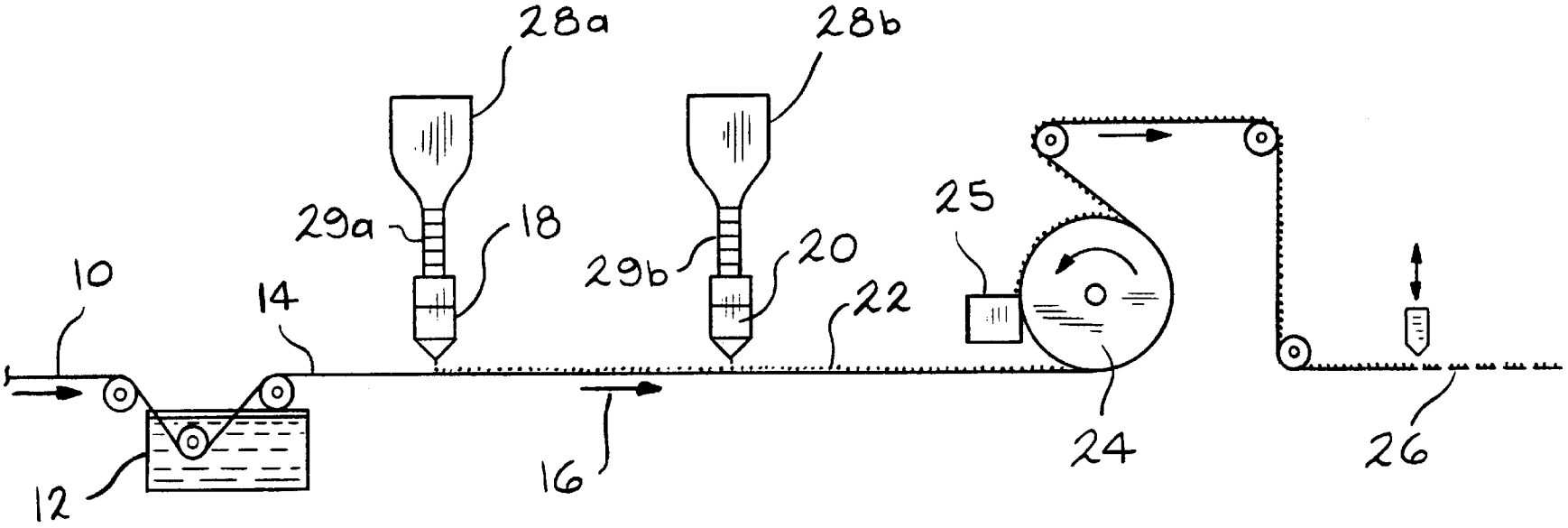
FIG. 1 is a schematic view in elevation of apparatus for producing shingles according to the principles of the invention.
Figure 2:
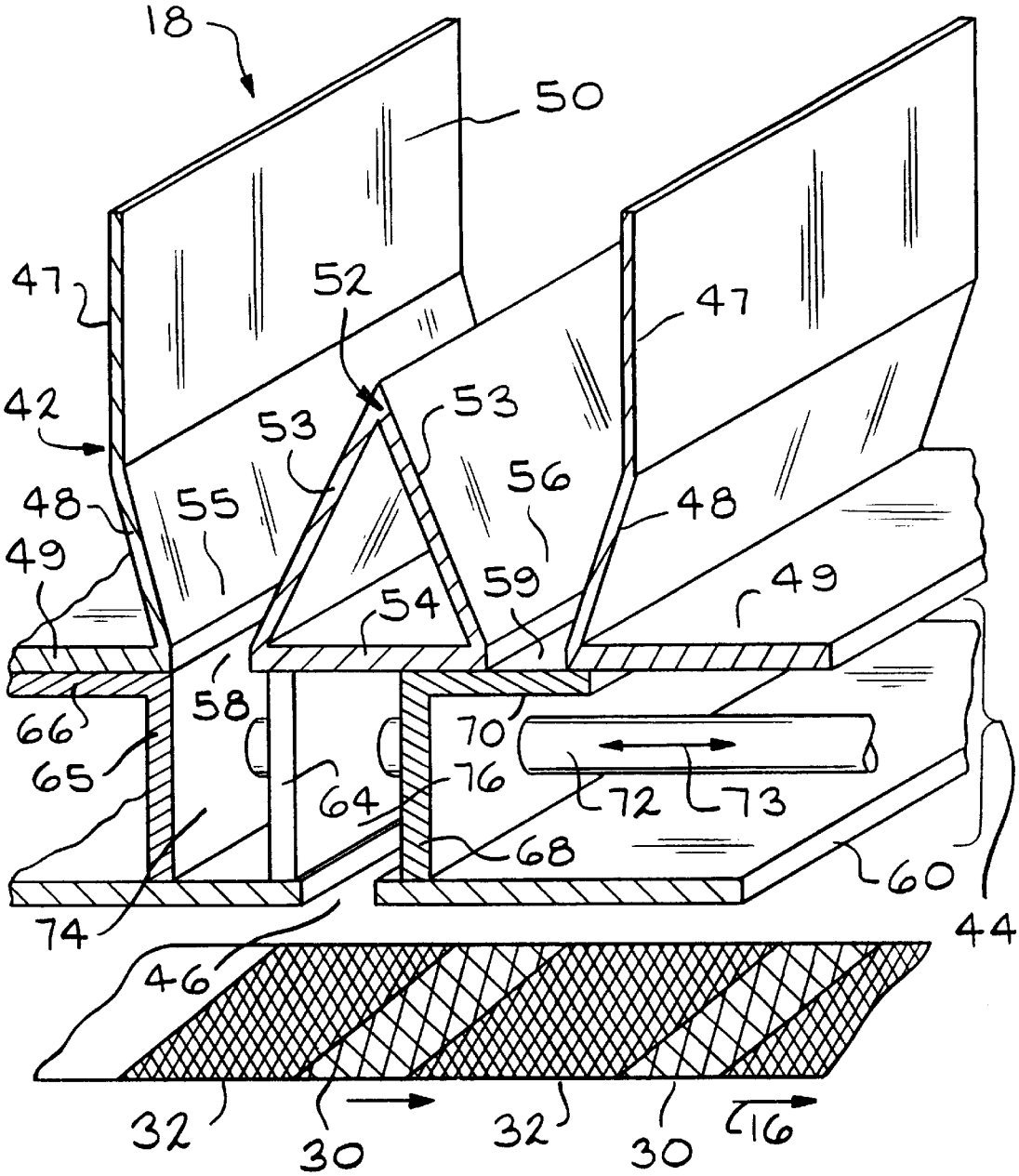
FIG. 2 is a perspective view of apparatus for dispensing granules according to the principles of the invention.

As shown in FIGS. 1 and 2, the base shingle mat 10, preferably a fiberglass mat, is passed through asphalt coater 12 to form an asphalt coated sheet 14, herein referred to as the sheet 14. The sheet moves at the machine speed in the machine direction as indicated by arrow 16. A series of granule dispensing nozzles 18, and 20 discharge granules onto the sheet to form a granule-coated asphalt sheet 22. The granule-coated asphalt sheet is turned around a slate drum 24 so that the excess granules can drop off, where they are collected by the backfall hopper 25. The granule-coated asphalt sheet is cut into shingles 26. The granules can be dropped from apertures (not shown) in the bottom of the nozzles using the force of gravity, or discharged from the nozzles 18, 20 using pneumatic pressure or any other suitable means. The granules are fed from hoppers 28*a* and 28*b* to the dispensing nozzles via hoses 29*a* and 29*b* respectively. The hoppers can be any suitable means for supplying granules to the nozzles. In a preferred design, granule dispensing nozzle 18 discharges blend drops, and dispensing nozzle 20, discharges background granules.

As shown in FIG. 2, the granules are deposited onto the sheet 14 in an intermittent manner to form a series of blend drops 30 which are separated by a series of background color areas, such as background color areas 32. The background color granules are discharged onto the sheet after the blend drops are discharged, as is well known in the art, although this is not shown in FIG. 2. For clarity, no granules are shown in FIG. 2.

Figure 3:
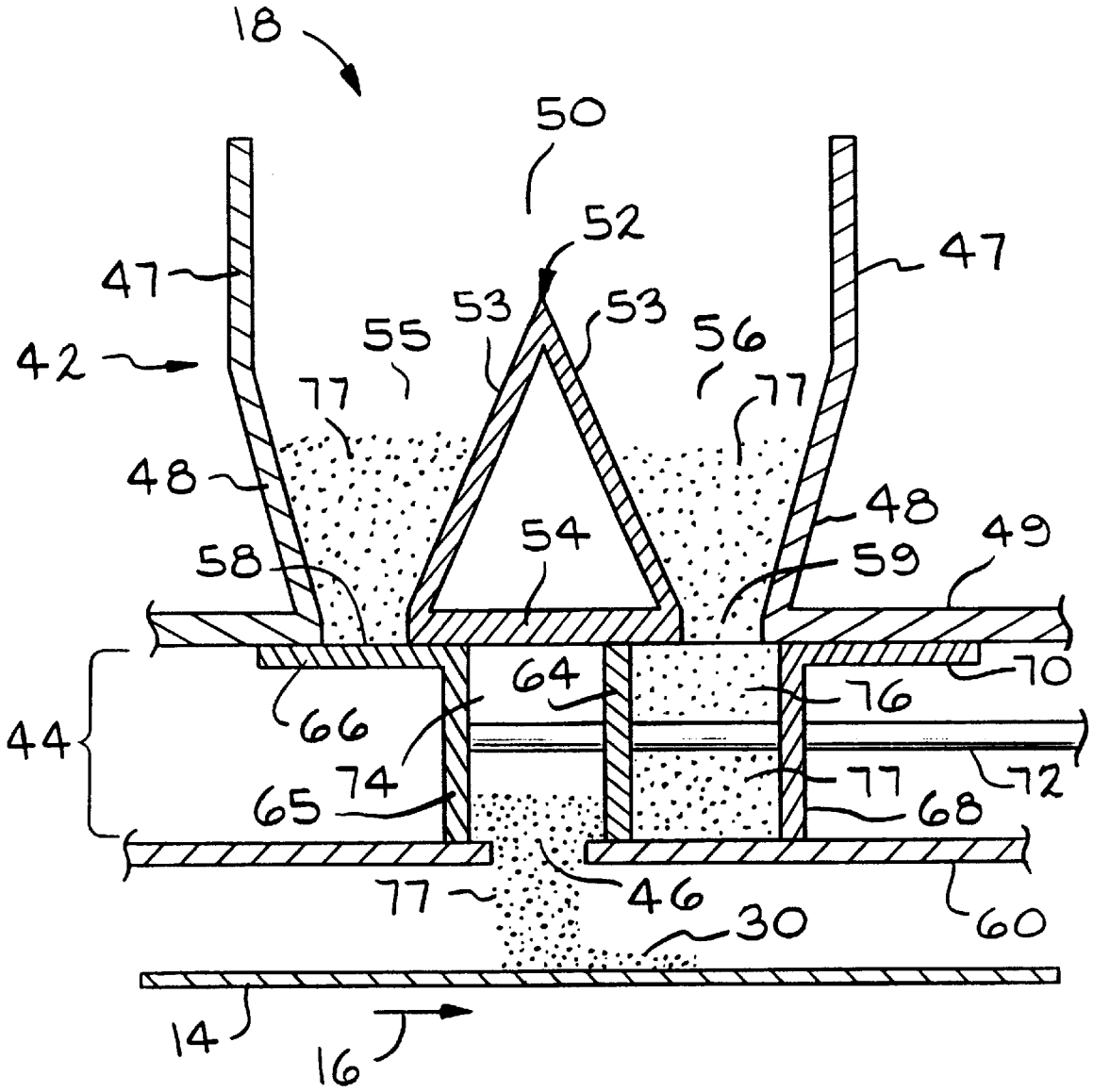
FIG. 3 is a schematic view in elevation of the apparatus for dispensing granules shown in FIG. 2.

As shown in FIGS. 2 & 3, the granule dispensing apparatus 18 of the invention is generally comprised of a granule feed assembly 42, a slidable divider 44 and a granule discharge slot 46. Although the entire dispensing apparatus including the feed chamber, the divider and the discharge slot are shown as extending transversely across the sheet, the dispensing apparatus may be configured to extend over only a portion of the width of the sheet. Also, the dispensing apparatus may be oriented at a predetermined angle to achieve the desired granule deposit. The granule feed assembly has an upper portion with opposed parallel walls 47, a lower portion with sloping walls 48 and bottom having horizontal walls 49 which are connected to the sloping walls and extend away from each other. The cross sectional area of the opening between the horizontal walls is less than the cross section area of the opening between the parallel walls due to the inwardly sloping walls 48. A central feed chamber 50 is formed between the parallel walls. Granules are supplied to the central feed chamber from a storage container such as a hopper (not shown). The hopper can be any suitable means for supplying granules to the granule feed chamber. An optional feed chamber separator 52 is disposed between the sloping feed chamber walls. The separator has sloping walls 53 which, together with the separator bottom 54, have a triangular cross section. The feed assembly walls and the separator walls together form funnel shaped left and right feed chambers 55 and 56. A left feed slot 58 is formed at the bottom of the left feed chamber between the junction of the sloping and horizontal feed assembly walls and the junction of the separator bottom and divider wall. A right feed slot 59 is formed at the bottom of the right feed chamber between the junction of the sloping and horizontal feed assembly walls and the junction of the separator bottom and divider wall.

A base plate 60 is positioned at the bottom of the granule dispensing apparatus. The discharge slot 46 is formed in the base plate. The divider 44 is disposed between the base plate and the granule feed assembly 42. The divider is comprised of a first wall or left wall 65, a second wall or right wall 68 and an intermediate wall 64. The left wall has a horizontal left flange 66. The left wall is shown as a vertical wall forming a generally 90 degree angle with left flange, but this angle may be different by sloping the left wall. The right wall 68 has a horizontal flange 70. The right wall is also shown as a vertical wall forming a generally 90 degree angle with right flange, but this angle may also be different by sloping the right wall. The left and right flanges 66 and 70 are adjacent the horizontal feed assembly walls 49. The left and right walls 65, 68 and the intermediate wall of the divider are spaced apart and fixed to an actuator rod 72. A left pocket 74 is defined by the left wall and the intermediate wall, and a right pocket 76 is defined by the right wall and the intermediate wall. The volumes of the left and right pockets are fixed because the walls are fixed to the actuator rod. Alternatively, the left, right and intermediate walls may be moveable along the actuator rod to alter the volume of the left and right pockets. The actuator rod is connected to an actuator (not shown) for axial movement left and right as shown by arrow 73.

The entire divider, including the left and right pocket, can be moved to the left and right by the actuator via the actuator rod. The divider is moved between a left position and a right position. With the divider in the left position, as shown in FIG. 2, the left pocket 74 is below the left feed slot 58. Granules in the left feed chamber fill the left pocket. The right pocket 76 is above the discharge slot and the granules in the right pocket fall through the discharge slot and are deposited onto the sheet. The right flange 70 blocks the right feed slot 59.

To discharge more granules and form another deposit, the actuator moves the divider to the right as shown in FIG. 3. For clarity, granules 77 are shown in the dispensing apparatus. The divider 44 is moved to the right by the actuator rod 72. The left pocket 74 containing granules and is moved over the discharge slot 46. The granules in the left pocket fall through the discharge slot and onto the sheet 14 to form a granule deposit 30. The sheet is moving in the machine direction as indicated by arrow 16. The left feed slot 58 is closed off by the horizontal wall 66. The right pocket 76 is moved beneath the open right feed slot 59. Granules in the right feed chamber fall through the right feed slot, filling the right pocket. The right pocket is over the base plate 60 and, therefore, no granules can fall onto the sheet from the right pocket.

The actuator is capable of moving the actuator rod back and forth very quickly. It is preferably a fluid operated cylinder, and can be either hydraulically or pneumatically powered. Alternatively, a servo drive actuator, not shown, can be used. The servo drive actuator uses a fast, precise stepping motor connected to a cam. The actuator rod is connected to the cam via a linkage which allows reciprocating movement of the actuator rod. As the motor turns the ca, the cam moves the actuator rod back and forth thereby moving the divider between the first and second positions. The actuator has a very short response time and can shuttle the divider quickly. The rapid movement of the divider is desirable to reduce the opening time of the discharge slot. As mentioned above, a short opening time for the discharge slot will produce a constant granule flow rate more quickly and produce a more uniform granule deposit.

A single discharge apparatus can be used to discharge granules onto the sheet, or multiple, independently controlled discharge apparatuses can be used to produce a variety of patterns of blend drop deposits. Alternatively, several discharge apparatuses, each having a separate discharge slot, can be interconnected. The actuator rod 72 can interconnect several dividers 44, with each divider having its own discharge slot. A single actuator can move all of the interconnected dividers to produce several granule deposits simultaneously.

Figure 4:
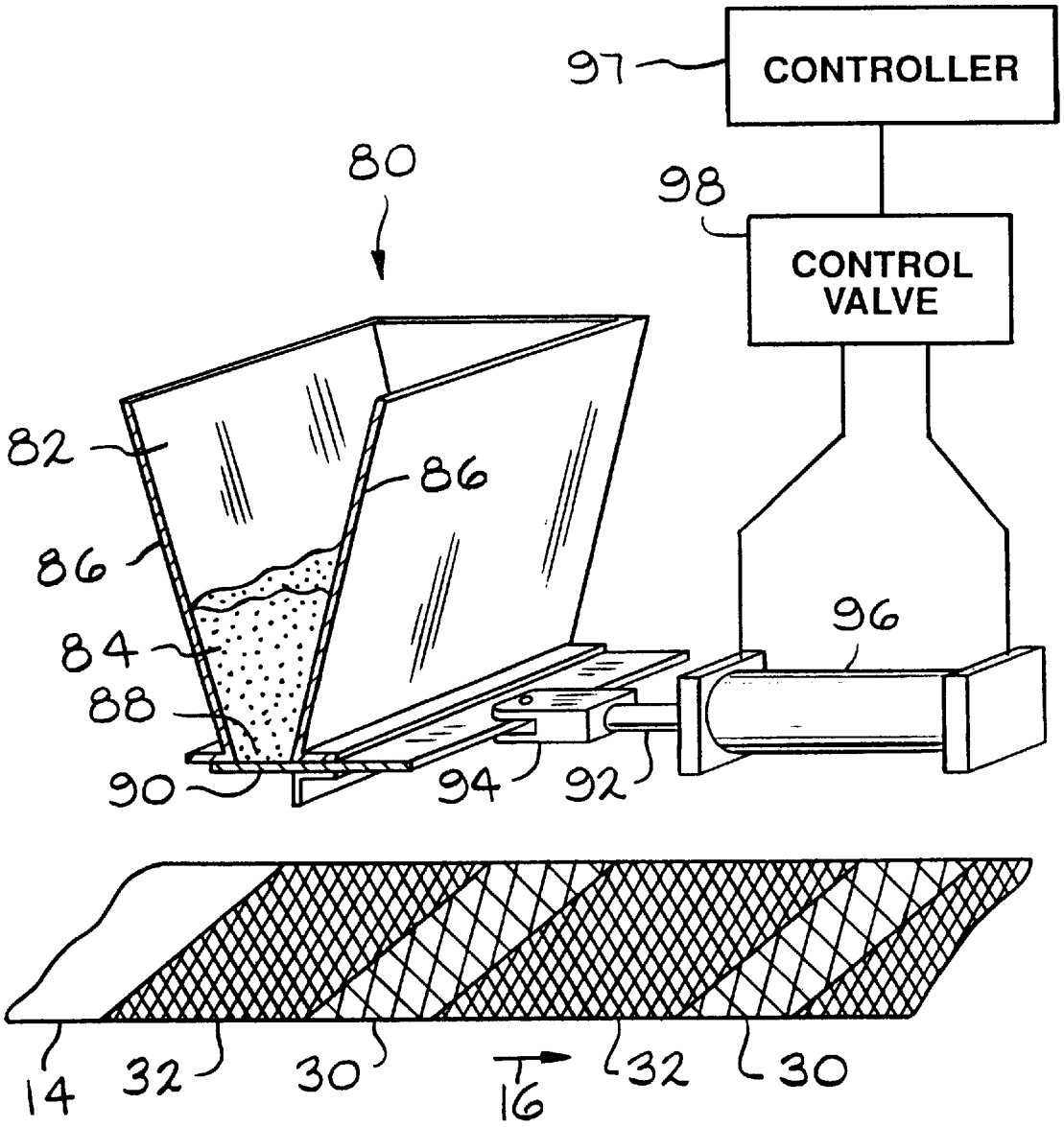
FIG. 4 is a perspective view of an alternate apparatus for dispensing granules according the principles of the invention.

An alternate embodiment of the invention includes a granule dispensing apparatus 80 as shown in FIG. 4. A granule feed chamber 82 holds granules 84 that are to be discharged onto an asphalt sheet 14 traveling in a machine direction 16. The feed chamber walls 86 slope together so that the cross sectional area of the feed chamber is larger at the top of the feed chamber than at the bottom. A discharge slot 88 is formed at the bottom of the feed chamber. Granules flow from the feed chamber, through the slot and onto the sheet. The granules can be moved using only the force of gravity, or pneumatic pressure can also be used. The feed chamber and discharge slot extend transversely across the sheet.

A slide gate 90 extends across the discharge slot adjacent the bottom of the feed chamber to block the flow of granules from the feed chamber. An actuator rod 92 is connected to the slidegate via a connector 94. An actuator 96 moves the actuator rod 92 which moves the slide gate. The actuator can be hydraulically powered or pneumatically powered. A controller 97 emits signals to the control valve 98 to regulate the fluid applied to the actuator, which then moves the actuator rod. The actuator rod moves the slide gate back and forth to open and close the discharge slot. The actuator is capable of moving the slide gate very quickly to minimize the gate's opening and closing times. As described above, a short opening and closing time will provide a more constant flow rate which produces granules deposits of increased uniformity. In addition to rapid movement, the actuator can cycle between the left and right position very quickly to open the slide gate for a very brief period. The brief open times can produce a short granule deposit on the moving sheet even when the sheet is traveling relatively quickly in the machine direction. For example, an actuator having a 5 msec. (0.005 sec.) response time is capable of moving from a first position to a second position in 5 msec. This actuator can open and close the slidegate in 10 msec. to produce a blend drop deposit only 1.2 inches long on a sheet traveling 600 feet per minute.

Figure 5:
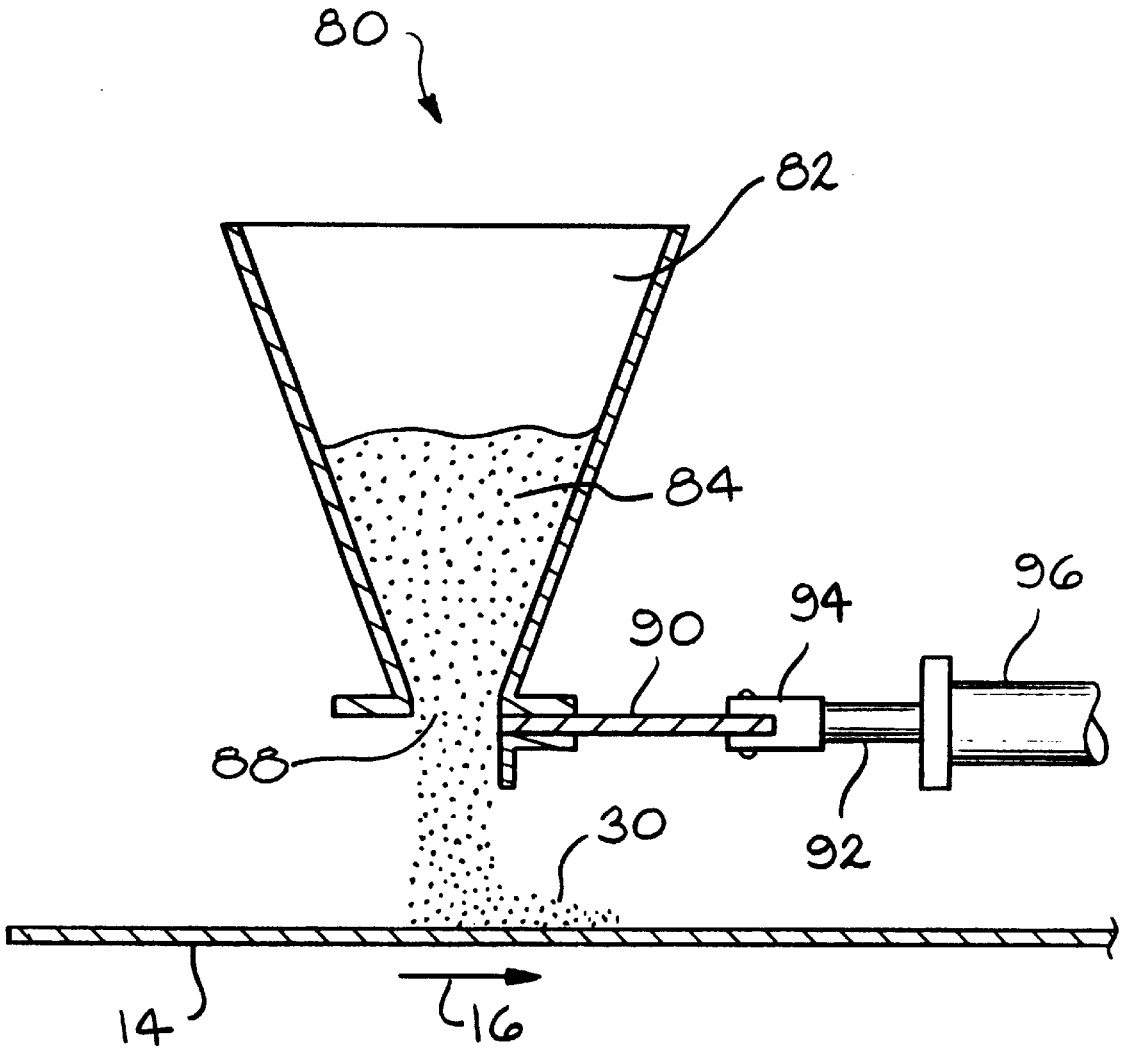
FIG. 5 is a schematic view in elevation of the apparatus for dispensing granules shown in FIG. 4.

The granule dispensing apparatus 88 is shown in FIG. 5 discharging granules onto the sheet 14 which is traveling in the machine direction 16. The actuator 96 has moved the actuator rod 92 and the slide gate 90 to the right. The slide gate is open and granules 84 are discharged through the discharge slot 88 and onto the sheet 14 producing a granule deposit 30.

The principle and mode of operation of this invention have been described in its preferred embodiment. However, it should be noted that this invention may be practiced otherwise than as specifically illustrated and described without departing from its scope.

Industrial Applicability

The invention can be useful in the manufacture of asphalt shingles.

What is claimed is:

1. A method for manufacturing an asphalt roofing material, comprising:

coating a continuous base mat with liquid asphalt to form a tacky asphalt-coated sheet; and discharging granules from a series of granule applicators onto the asphalt-coated sheet to form a granule-coated asphalt sheet, at least one of the granule applicators discharging blend drops of granules onto the asphalt-coated sheet, the discharging of a blend drop comprising:

discharging granules through a discharge slot of a granule feed chamber onto the asphalt-coated sheet, and controlling the discharge of a blend drop of granules by moving a slidegate with an actuator between an open position in which the slidegate opens the discharge slot so that granules are discharged through the discharge slot, and a closed position in which the slidegate closes the discharge slot so that granules are not discharged through the discharge slot, wherein the actuator moves the slidegate between the open position and the closed position with sufficient quickness to produce a blend drop on the asphalt-coated sheet having a uniform distribution of granules.

2. The method of claim 1 in which the actuator moves the slidegate with sufficient quickness to produce a blend drop having sharp leading and trailing edges.

3. The method of claim 1 in which the granules are discharged under pressure from the feed chamber through the discharge slot.

4. The method of claim 1 in which the actuator moves the slidegate from the closed position to the open position in less than about 10 msec.

5. The method of claim 1 in which the actuator moves the slidegate from the open position to the closed position in less than about 10 msec.

6. The method of claim 1 in which the actuator moves the slidegate from the closed position to the open position, and then from the open position to the closed position, in a total time of less than about 20 msec.

7. The method of claim 1 in which the step of discharging granules through a discharge slot comprises discharging the granules through a discharge slot extending transverse to a direction of movement of the asphalt-coated sheet.

8. The method of claim 1 in which the actuator is fluid actuated to move the slidegate.

9. The method of claim 8 in which the actuator is pneumatically actuated to move the slidegate.

10. The method of claim 8 in which the actuator is hydraulically actuated to move the slidegate.

11. An apparatus for manufacturing an asphalt roofing material from a continuous base mat comprising:

a conveyor which moves the base mat;

a coater containing liquid asphalt, the conveyor moving the base mat through the coater to form a tacky asphalt-coated sheet; and a series of granule applicators which discharge granules onto the asphalt-coated sheet to form a granule-coated asphalt sheet, the conveyor moving the asphalt-coated sheet beneath the granule applicators, at least one of the granule applicators being a blend drop granule applicator which discharges blend drops of granules onto the asphalt-coated sheet, the blend drop granule applicator comprising:

a granule feed chamber;

a discharge slot in the feed chamber which discharges granules onto the asphalt-coated sheet;

a slidegate mounted to open and close the discharge slot; and an actuator which moves the slidegate between an open position and a closed position to control the discharge of a blend drop of granules onto the asphalt-coated sheet, the actuator moving the slidegate between the open position and the closed position with sufficient quickness to produce a blend drop on the asphalt-coated sheet having a uniform distribution of granules.

12. The apparatus of claim 11 in which the actuator moves the slidegate with sufficient quickness to produce a blend drop having sharp leading and trailing edges.

13. The apparatus of claim 11 further comprising pressure means connected to the feed chamber which discharges the granules from the feed chamber under pressure through the discharge slot.

14. The apparatus of claim 11 in which the actuator moves the slidegate from the closed position to the open position in less than about 10 msec.

15. The apparatus of claim 11 in which the actuator moves the slidegate from the open position to the closed position in less than about 10 msec.

16. The apparatus of claim 11 in which the actuator moves the slidegate from the closed position to the open position, and then from the open position to the closed position, in a total time of less than about 20 msec.

17. The apparatus of claim 11 in which the discharge slot extends transverse to a direction of movement of the asphalt-coated sheet beneath the blend drop granule applicator.

18. The apparatus of claim 11 in which the actuator is fluid operated.

19. The apparatus of claim 18 in which the actuator is pneumatic.

20. The apparatus of claim 18 in which the actuator is hydraulic.

* * * * *